US009609454B2

(12) United States Patent
Haurais et al.

(10) Patent No.: US 9,609,454 B2
(45) Date of Patent: Mar. 28, 2017

(54) METHOD FOR PLAYING BACK THE SOUND OF A DIGITAL AUDIO SIGNAL

(71) Applicants: Jean-Luc Haurais, Paris (FR); Franck Rosset, Brussels (BE)

(72) Inventors: Jean-Luc Haurais, Paris (FR); Franck Rosset, Brussels (BE)

( * ) Notice: Subject to any disclaimer, the term of this patent is extended or adjusted under 35 U.S.C. 154(b) by 0 days.

(21) Appl. No.: 14/785,061

(22) PCT Filed: Apr. 9, 2014

(86) PCT No.: PCT/FR2014/050846

§ 371 (c)(1),
(2) Date: Oct. 16, 2015

(87) PCT Pub. No.: WO2014/170580

PCT Pub. Date: Oct. 23, 2014

(65) Prior Publication Data

US 2016/0080882 A1 Mar. 17, 2016

(30) Foreign Application Priority Data

Apr. 17, 2013 (FR) ..... 13 53473

(51) Int. Cl.
*H04R 5/033* (2006.01)
*G10L 21/0208* (2013.01)
(Continued)

(52) U.S. Cl.
CPC ..... *H04S 5/00* (2013.01); *H04R 5/04* (2013.01); *H04S 3/008* (2013.01); *H04S 7/303* (2013.01);
(Continued)

(58) Field of Classification Search
CPC ... G10K 2210/1081; G10K 2210/3051; G10K 2210/3028; G10L 21/0208; G10L 21/0364; H03H 17/0628; H04S 7/304
(Continued)

(56) References Cited

U.S. PATENT DOCUMENTS

| | | | |
|---|---|---|---|
| 5,467,401 | A | 11/1995 | Nagamitsu et al. |
| 2006/0045294 | A1 | 3/2006 | Smyth |
| 2012/0014527 | A1 | 1/2012 | Furse |

FOREIGN PATENT DOCUMENTS

| | | | |
|---|---|---|---|
| EP | 2119306 | A2 | 11/2009 |
| WO | 9725834 | A2 | 7/1997 |

(Continued)

*Primary Examiner* — George Monikang
(74) *Attorney, Agent, or Firm* — Bachman & LaPointe, P.C.

(57) ABSTRACT

A method for playing back the sound of a digital audio signal comprising an oversampling step consisting of producing, from a signal sampled at a frequency F, a signal sampled at a frequency N×F, where N corresponds to an integer greater than 1, then of applying convolution processing to a first digital file sampled at a frequency N×F corresponding to the acquisition of the soundscape of a reference sound space, a second digital file sampled at a frequency N×F corresponding to the acquisition of the noise footprint of a piece of reference playback equipment, a third digital file sampled at a frequency N×F corresponding to the acquisition of the noise footprint of an equalizer and a fourth file corresponding to said oversampled audio file, the resulting digital packets then undergoing digital conversion processing at a sampling frequency F/M corresponding to the working frequency of the listening equipment.

2 Claims, 1 Drawing Sheet

(51) Int. Cl.

| | |
|---|---|
| ***H04S 5/00*** | (2006.01) |
| ***H04R 5/04*** | (2006.01) |
| ***H04S 7/00*** | (2006.01) |
| ***H04S 3/00*** | (2006.01) |

(52) U.S. Cl.
CPC ..... *H04R 2205/021* (2013.01); *H04S 7/304* (2013.01); *H04S 2400/01* (2013.01); *H04S 2400/05* (2013.01); *H04S 2400/07* (2013.01); *H04S 2400/11* (2013.01); *H04S 2400/15* (2013.01)

(58) Field of Classification Search
USPC ..... 381/17–19, 74, 309, 310, 94.1–94.3; 700/94
See application file for complete search history.

(56) References Cited

FOREIGN PATENT DOCUMENTS

| | | | |
|---|---|---|---|
| WO | 9914983 | A1 | 3/1999 |
| WO | 2008106680 | A2 | 9/2008 |
| WO | 2012172264 | A1 | 12/2012 |

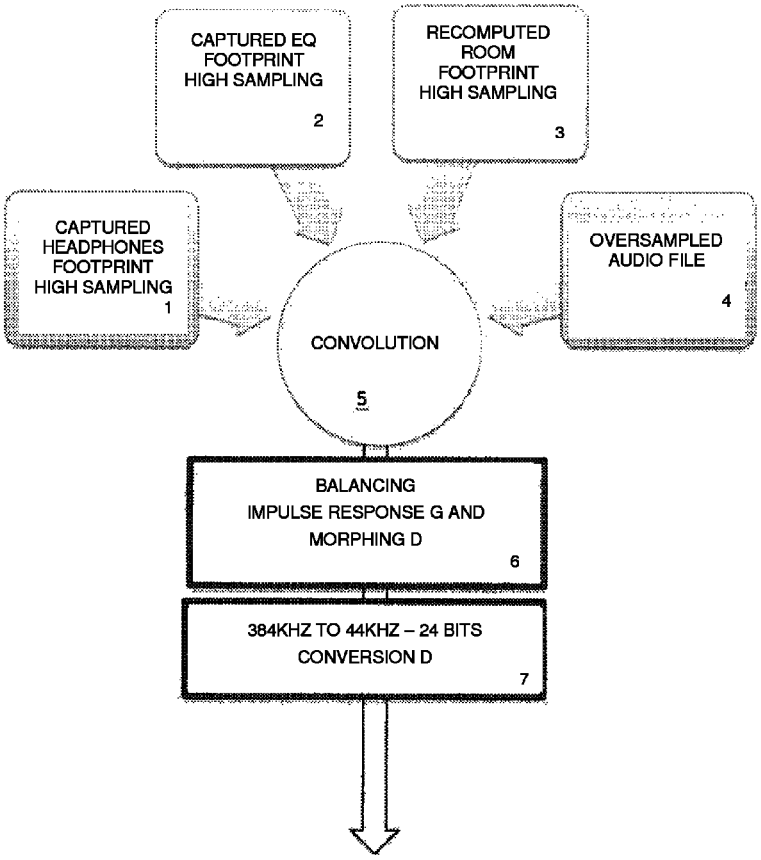
CAPTURED EQ FOOTPRINT HIGH SAMPLING
2
RECOMPUTED ROOM FOOTPRINT HIGH SAMPLING
3
CAPTURED HEADPHONES FOOTPRINT HIGH SAMPLING
1
OVERSAMPLED AUDIO FILE
4
CONVOLUTION
5
BALANCING IMPULSE RESPONSE G AND MORPHING D
6
384KHZ TO 44KHZ – 24 BITS CONVERSION D
7

METHOD FOR PLAYING BACK THE SOUND OF A DIGITAL AUDIO SIGNAL

BACKGROUND

The present invention relates to the field of audio signal processing to improve the perception upon playing back.

International patent application WO2012088336 is known for example, which describes a method of processing an audio sound source to create four-dimensional spatialized sound.

A virtual sound source can be moved along a path in a three-dimensional space over a specified period of time to obtain the location of the four-dimensional sound.

The various embodiments described herein provide methods and systems for converting existing mono, 2-channel and/or multi-channel audio signals into spatialized audio signals having two or more audio channels.

The various embodiments also describe the methods, systems and apparatus for generating low-frequency effects, and center channel signals from incoming audio signals having one or more channels.

A device is known from the patent application WO9914983, which makes it possible to create and use a pair of opposing loudspeakers of headphones, with the sensation of a sound source being moved away from the area between said loudspeakers. The device comprises:

- a series of audio inputs representing audio signals projected from a theoretical sound source located remotely from the theoretical listener;
- a first mixing matrix, connected to the audio inputs and a series of feedback inputs, which produces a predetermined combination of said audio inputs composing intermediate output signals;
- a filter system, which filters said intermediate output signals and generates filtered intermediate output signals and the series of feedback inputs, and which comprises separate filters for filtering the direct response and the fast response and an approximation of the reverberated response, and for filtering the feedback response so as to generate the feedback inputs; and
- a second mixing matrix, which combines the filtered intermediate output signals so as to produce right channel and left channel stereo outputs.

European Patent EP2119306 describes a device for processing an audio sound source to create four-dimensional spatialized sound. A virtual sound source can be moved along a path in a three-dimensional space over a specified period of time to obtain the location of the four-dimensional sound.

A binaural filter for a desired space point is applied to the audio waveform to produce a spatialized waveform so that, when the spatialized waveform is played from a pair of loudspeakers, the sound seems to come from the selected space point instead of the loudspeakers.

A binaural filter for a space point is simulated by interpolation of the nearest one of the binaural filters selected from a plurality of predefined binaural filters.

The audio waveform can be digitally processed by overlapping data blocks using a Fourier transform short time.

The located sound can be subsequently processed for chamber and Doppler shift simulation.

The present invention relates to a method for processing an original audio signal having N.x channels, with N being greater than 1 and x being greater than or equal to 0, comprising a step of multi-channel processing said input audio signal using a multichannel convolution with a predefined footprint, said footprint being developed by the capture of a reference sound by a loudspeaker system placed in a reference space characterized in that it comprises an additional step of selecting at least one footprint of a plurality of footprints previously developed in different sound environments.

The patent application WO2012172264 discloses a method for processing an original audio signal having N.x channels, with N being greater than 1 and x being greater than or equal to 0, comprising a step of multi-channel processing said input audio signal by a multichannel convolution with a predetermined footprint, with said footprint being developed by the capture of a reference sound by a loudspeaker system placed in a reference space characterized in that it comprises an additional step of selecting at least one footprint of a plurality of footprints previously developed in different sound environments.

The patent application WO9725834 provides another method and device for processing multichannel audio signals, with each channel corresponding to a loudspeaker placed at a particular point of a room so as to give, via headphones, the impression that multiple "ghost" loudspeakers are distributed over the room. HRTF (Head Related Transfer Functions) transfer functions are selected with respect to the head while taking into account the height and azimuth of each considered loudspeaker with respect to the listener. Each channel is subject to HRTF filtering so that, when such channels are combined into the left and right channels and output by headphones, the listener has the impression that the sound actually comes from the ghost loudspeakers distributed in the virtual room. Sets of HRTF coefficients entered into databases from a large number of individuals and the use, for the concerned listener, of an optimal HRTF set provides him/her with listening impressions similar to the one which an isolated listener would have if listening to multiple loudspeakers distributed throughout the volume of a room. The application of an HRTF function at the output of left and right channels makes it possible, when listening with headphones, to give the impression of listening without headphones.

Prior art solutions are limited by the intrinsic qualities of playback means (headphones or loudspeakers) and the suitability thereof for the processing applied to the audio signal.

In addition, some processing of the prior art require significant computing power, incompatible with the capabilities of tablets, phones or portable players.

SUMMARY

The object of the present invention is to improve the perceived quality and in particular the extent of spatialization, including with medium quality playback means such as docking stations of tablets or mobile phones ("docks").

For this purpose, the invention in its broadest sense, relates to a method for playing back a sound of a digital audio signal characterized in that a step of oversampling is executed which consists in producing from a signal sampled at a frequency F, a signal sampled at a frequency N×F, where N is an integer greater than 1, then in applying convolution processing to a first digital file sampled at a frequency N×F corresponding to the acquisition of the soundcape of a reference sound space, a second digital file sampled at a frequency N×F corresponding to the acquisition of the noise footprint of a piece of reference playback equipment, and a third digital file sampled at a frequency N×F corresponding to the acquisition of the noise footprint of an equalizer and a fourth file corresponding to said oversampled audio file, with the resulting digital packets then undergoing a digital conversion processing at a sampling frequency F/M corresponding to the working frequency of the listening equipment.

The processing is based on a mathematical convolution operation, and uses several prerecorded audio samples of the impulse response of the modeled space as well as an equalizer and playback equipment.

In one alternative embodiment, the method includes an additional step of recomputing the file corresponding to said noise footprint of the reference sound space, so as to change the balance between the space channels of said noise footprint.

BRIEF DESCRIPTION OF THE DRAWING

The invention will be better understood upon reading the following description, referring to the appended drawings corresponding to non-restrictive embodiments wherein:

FIG. 1 represents a schematic view of the signal processing methods of the invention.

DETAILED DESCRIPTION

The processing method according to the invention consists in producing different acoustic footprints of a sound source, in order to achieve a convolution of such various noise footprints.

The convolutions technology is a known capture technique implemented by the user, then the reproduction of the acoustic behavior of a location or a device. For example, the convolution reverberations make it possible to propose using the acoustics of many real places, famous concert halls or other places: such previously sampled acoustics may be reused at will within the program.

In the case of sound on picture, the first considered exploitation of this possibility was the capture of acoustics on filming sets in order to get direct acoustic links between the direct sounds and the sounds added in post-production (post-synchronizing, sound effects).

The principle then consists in executing the sampling of the acoustics on the sets where scenes of the movie have been shot, in order to be able to easily apply such acoustics to the elements recorded afterwards so that they fit perfectly with the sounds from the direct sound recordings.

The Impulse Response sensor to obtain the impulse response of a piece of equipment or a room constituting the noise footprint is based on "deconvolution". It uses the excitation of the system by a known signal (referred to herein as f(t)). Such signal is such that if a transform (deconvolution function) is applied thereto, the result is the Dirac function.

The deconvolution function is so chosen that, for the excitation signal f(t) and any function h(t):

$$G[f(t)]=\delta(t)$$

$$G[f(t)=G[h(t)]*f(t)=G[f(t)]*h(t)$$

With this deconvolution function, an impulse response signal of a system is produced from the response thereof to an excitation signal different from the Dirac pulse.

Upon listening, the types of signals used to capture impulse responses sound like a Gaussian noise or a "white noise". The excitation sequences are generated by a deterministic algorithm and are periodic (periods of the order of a few seconds or tens of seconds for our application) and form a pseudo-random signal.

Such sequences are created by linear feedback shift registers (LFSR). Such register structure, the order of which is determined by the number of registers, is such that, over its period, it will produce all the possible binary values for its order (if the structure is of the fourth order, $2^n$ values are possible). Such sequences are known by the persons skilled in the art as "MLS for Maximum Length Sequence": the longest possible sequence of binary numbers without repeating twice the same value.

The initial popularity of the MLS is based on the simplicity of the deconvolution method.

As a matter of fact, the MLS signal is such that for the deconvolution thereof, a transform can be used known as the Hadamard transform, which simplifies the calculations and has the advantage of being calculable by a computer using few resources.

Another excitation signal solution is based on the so-called "logarithmic sweep" or "exponential sweep" technique, which corresponds, as the name suggests, to a shifting sinus the frequency of which is related to time by an exponential law. This implies that the shifting is faster at high frequencies than at low frequencies, and consequently its spectrum is that of a pink noise (less energy is released at high frequencies since less time is used).

The measures taken can be deconvoluted in two ways. The first one uses the passage in the frequency domain to execute computing prior to returning to the time domain. The second one consists in not periodically convoluting the recorded signal with the temporally returned excitation signal:

$$h(t)=r(t)s^*(t-T)$$

where T is the sweep duration.

With this procedure, two advantages appear:

- The non-linear distortions of the system are totally rejected and do not disturb the measurement of the linear impulse response of the system
- The method tolerates slight audio video splits: the sweep can be broadcast from a device and be recorded by another without these two machines being synchronized by a clock.

In the present invention, three noise footprints or impulse responses are captured, which correspond to:

- a noise footprint of a listening means, for example a headset
- a noise footprint of an equalizer
- a noise footprint of a reference sound space.

Each of these impulse responses is captured from a reference signal with a high sampling, above the nominal sampling frequency of the playback equipment.

For example, the room footprint 3 is acquired from a white noise producing a 6 MByte file per loudspeaker, for a long time greater than 500 milliseconds, preferably between one and two seconds. The file corresponding to the impulse response is then compressed without loss (ZIP compression for example) and encrypted.

The footprint of the headphones 1 (or a series of loudspeakers) is acquired in the same way with a white or a pink signal having a duration of about 200 milliseconds, preferably between 100 and 500 milliseconds.

The footprint of the equalizer 2 is acquired in the same way with a white or a pink signal having a duration of about 200 milliseconds, preferably between 100 and 500 milliseconds for each equalizer setting.

These three impulse response files 1 to 3 as well as the digital file of the audio signal 4 undergo convolution processing 5 based on processing by fast Fourier transform FFT.

To reduce the computing time, a step 6 is executed, which makes it possible to dynamically recalculate the left and right footprints depending on the particularities of the playback equipment and if appropriate on the listener's sensory characteristics. An adjusting means making it possible to change the virtual spatial position is available, for instance. A change in this setting controls the computing of a new pair of noise footprints from the footprints originally provided by morphing:

- a central virtual speaker and two footprints for the right loudspeaker and the left loudspeaker are taken into account
- the left/right footprints are recomputed in real time to move the sound spot This function can be controlled by the gyro sensor to create a dynamic movement of the sound spot based on the user's movements.

It makes it possible to center the voice in real time relative to the head.

The invention claimed is:

1. A method for playing back the sound of a digital audio signal, comprising: a step of oversampling is executed, which consists in producing, from a signal sampled at a frequency F, a signal sampled at a frequency N×F, where N corresponds to an integer greater than 1, then in applying convolution processing to a first digital file sampled at a frequency N×F corresponding to the acquisition of the soundscape of a reference sound space, a second digital file sampled at a frequency N×F corresponding to the acquisition of the noise footprint of a piece of reference playback equipment, a third digital file sampled at a frequency N×F corresponding to the acquisition of the noise footprint of an equalizer and a fourth file corresponding to said oversampled audio file, with the resulting digital packets then undergoing digital conversion processing at a sampling frequency F/M corresponding to the working frequency of the listening equipment.

2. The method for playing back the sound of a digital audio signal according to claim 1, further comprising an additional step of recomputing the file corresponding to said noise footprint of the reference sound space, so as to change the balance between the space channels of said noise footprint.

* * * * *